US009527517B2

(12) United States Patent
Westman et al.

(10) Patent No.: US 9,527,517 B2
(45) Date of Patent: Dec. 27, 2016

(54) COUPLER HEAD WITH COUPLER HOUSE MADE OF SHEET METAL

(75) Inventors: Anders Westman, Falun (SE); Anders Svedbo, Stora Skedvi (SE)

(73) Assignee: EGO INTERNATIONAL B.V., Brussels (BE)

( * ) Notice: Subject to any disclaimer, the term of this patent is extended or adjusted under 35 U.S.C. 154(b) by 395 days.

(21) Appl. No.: 14/124,892

(22) PCT Filed: Jun. 7, 2012

(86) PCT No.: PCT/SE2012/050604

§ 371 (c)(1),
(2), (4) Date: May 7, 2014

(87) PCT Pub. No.: WO2012/169959

PCT Pub. Date: Dec. 13, 2012

(65) Prior Publication Data

US 2014/0251937 A1 Sep. 11, 2014

(30) Foreign Application Priority Data

Jun. 9, 2011 (SE) ..... 1150526

(51) Int. Cl.
*B61G 7/00* (2006.01)
*B61G 3/16* (2006.01)

(52) U.S. Cl.
CPC .. *B61G 7/00* (2013.01); *B61G 3/16* (2013.01)

(58) Field of Classification Search
CPC ..... B61G 3/16; B61G 7/14; B61G 3/00
(Continued)

(56) References Cited

U.S. PATENT DOCUMENTS 5,509,548 A 4/1996 Kreher
8,596,475 B2 12/2013 Kobert et al.
(Continued)

FOREIGN PATENT DOCUMENTS

DE 9418999 U1 2/1995
EP 1 894 808 A2 3/2008
(Continued)

OTHER PUBLICATIONS

Extended European Search Report, dated Oct. 17, 2014, from corresponding EP application.
(Continued)

*Primary Examiner* — Mark Le
(74) *Attorney, Agent, or Firm* — Young & Thompson

(57) ABSTRACT

Coupler head includes a coupler house for containing components included in a mechanical coupling and for supporting a front plate. The coupler house has two separate elongate shell-shaped house parts, which in mutually opposite and open long sides are individually joined to the outside of a beam running centrally in the coupler head and in a rear end is adapted to be coupled to a drawbar and in a front end adapted for bearing a main shaft included in the coupling, the parts being joined to the outside of the beam by welding seams running in the beam's longitudinal direction, whereby tractive forces are transferred from the coupling to the drawbar via the beam without loading the parts and seams, while thrust forces are transferred from the plate to the beam and the drawbar via the parts and seams without loading the coupling, its main shaft and the latter's bearing.

13 Claims, 3 Drawing Sheets

(58) Field of Classification Search
USPC ..... 213/104, 75 R, 100 R, 77, 39
See application file for complete search history.

(56) References Cited

U.S. PATENT DOCUMENTS

| | | | | |
|---|---|---|---|---|
| 2007/0187350 | A1 | 8/2007 | Kontetzki | |
| 2010/0322706 | A1* | 12/2010 | Kolshorn | B61G 5/04 403/404 |

FOREIGN PATENT DOCUMENTS

| | | | |
|---|---|---|---|
| EP | 2384948 | A1 | 11/2011 |
| FR | 1275879 | A | 12/1960 |
| GB | 867609 | A | 5/1961 |

OTHER PUBLICATIONS

International Search Report, dated Aug. 10, 2012, from corresponding PCT application.

* cited by examiner

COUPLER HEAD WITH COUPLER HOUSE MADE OF SHEET METAL

TECHNICAL FIELD OF THE INVENTION

The present invention relates to a coupler head in automatic couplers for rail vehicles comprising a coupler house serving to contain and protect components included in a mechanical coupling, such as central plate, main shaft, and coupling link, by which rail vehicles are coupled to each other. More precisely, the invention relates to a coupler head the coupler house of which is made of sheet metal.

BACKGROUND AND PRIOR ART

Automatic couplers for rail vehicles typically comprise a drawbar that in one end is articulately attached in the chassis of a rail vehicle, and in its other end carries a coupler head having a coupling adapted to couple automatically to a correspondingly formed coupler. Usually, the coupler head has a cast coupler house in which the main shaft of the coupling is journalled. A coupling link extends forward from a central plate rotatably mounted on the main shaft and automatically engages the central plate of the meeting coupler when the couplers are brought together. For the guidance of the couplers, a guide cone serves that protrudes from the front plate of the coupler head and is received in a correspondingly shaped opening in the front plate of the meeting coupler, when the couplers approach each other.

In normal operation, the coupler head and the coupler house are subjected to repeated tensile and compressive loads that in course of time could cause fatigue of materials and joints unless these were dimensioned with safety margin. Therefore, the cast coupler house is typically a comparatively heavy component in an automatic coupler, dimensioned to resist thrust forces upon coupling at relative speeds of up to 15 km/h, as well as thrust and tractive forces that arise by repeated jerking in the coupler during travelling.

SUMMARY OF THE INVENTION

The invention aims at reducing the weight of an automatic coupler intended for the coupling of rail vehicles. Another object is to provide a coupler head that can be manufactured by a production process that is simplified in comparison with casting and with a decreased need of finishing and reduced rejection.

According to the invention, both these objects are achieved by a coupler head the coupler house of which is made of sheet metal.

More precisely, according to the invention, there is provided a coupler head with a coupler house consisting of two separate elongate shell-shaped house parts, which in mutually opposite and open long sides are individually joined to the outside of a beam that runs centrally in the coupler head and in a rear end is adapted to be coupled to a drawbar and in a front end adapted for the mounting of and bearing a main shaft included in the mechanical coupling, the parts of the coupler house being joined to the outside of the beam by means of welding seams that mainly run in the longitudinal direction of the beam.

In a coupler head formed in this way, all tractive forces from the coupling are transferred to the drawbar via the centrally running beam, while said house parts and welding seams only are loaded by occurring thrust forces.

More precisely, tractive forces (see arrow D in attached FIG. 6) are transferred from the coupling to the drawbar via the centrally running beam without loading said house parts and welding seams, while thrust forces (see arrow T in FIG. 6) are transferred from the front plate to the beam and the drawbar via the parts of the coupler house and welding seams without loading the coupling, the main shaft thereof and the bearing of the main shaft in the beam.

In other words, the forces that act in compressive and tensile load partly find different ways through the coupler head. From this, it is also clear that the risk of fatigue of welding seams in a coupler house made of sheet steel can be reduced.

It is preferred that the respective house part, by a plurality of longitudinally running bendings, forms a shell, which consists of several sides and the bendings of which extend from the beam in diverging directions forward toward the front plate.

By this design, each house part forms a self-supporting box, by which thrust forces are propagated at an acute angle inward toward the beam. More precisely, the house part may be compared to a truncated cone or polygonal pyramid that is cut-off at an acute angle a to its symmetry axis S, and is welded to the centrally running beam in the cut edges (as illustrated in attached FIG. 6).

Alternatively, the house parts may be made as obliquely truncated cones with a circular or oval cross-section, or with a cross-section that contains both straight and arched segments in combination, produced by bending and/or by compression-moulding, In a preferred embodiment, the respective house part embraces an essentially plane and vertically standing side formed between an upper side angled in two or more different planes and an under side angled in two or more different planes.

Alternatively, the upper and/or under side may be made arched and united by a plane vertical side.

It is suitable that the coupler house, in particular on the vertical sides of the coupler house, and preferably outside the coupler house, is adapted for the mounting of control members for the mechanical coupling. It is further suitable that the beam, on its upper and/or under side, is adapted for the mounting of connection members for the supply of the vehicle, such as connection members for air, oil, electricity. For this purpose, attachments may be arranged on the coupler house and access openings be recessed through the wall of the coupler house.

It should be emphasized that, by two house parts, reference is made to a left and a right house part, which does not exclude that one of them, or both, per se, may be composed of or comprise several parts, which upon mounting form a left and a right house part, respectively, of the coupler house.

Preferably, the beam is formed of a pipe that through recesses in its wall connects the spaces in the two coupler house parts when these are welded to the beam. The front end of the beam, which by the two opposite and laterally positioned recesses may be compared to a fork with an upper and a lower branch, is suitably reinforced for bearing the main shaft of the coupling in the mutually vertically aligned branches.

BRIEF DESCRIPTION OF THE DRAWINGS

An embodiment example of the invention is explained in more detail below, reference being made to accompanying schematic drawing figures. In the same.

DETAILED DESCRIPTION OF THE EMBODIMENT EXAMPLE

Figure 1:
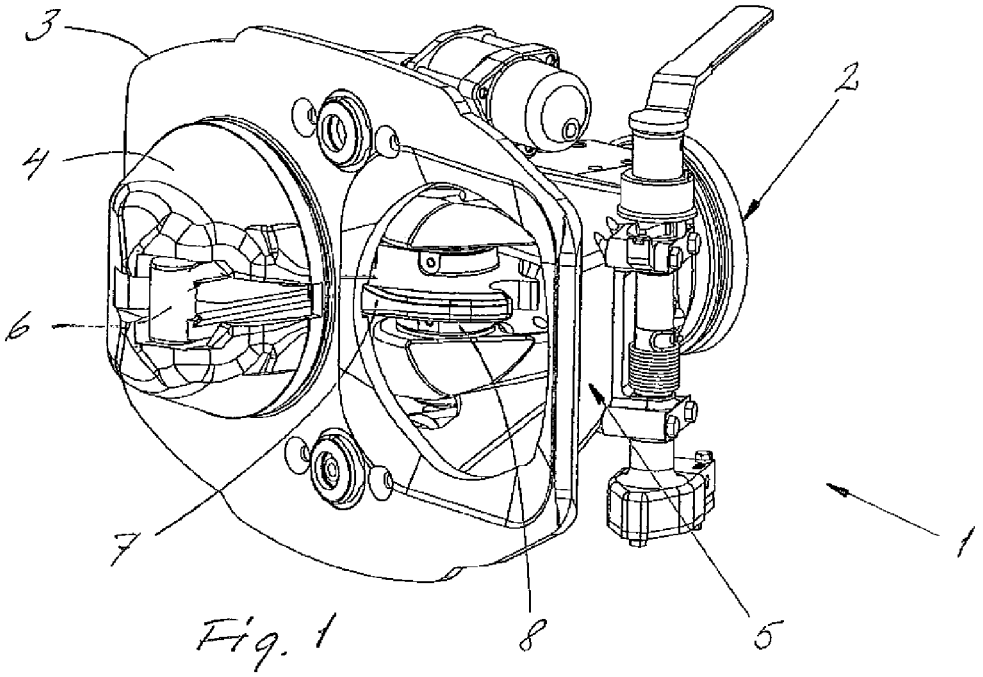
FIG. 1 shows a coupler head according to the invention in perspective from the front.

In the drawing figures, there is shown a coupler head 1, which, in the shown embodiment, in a rear end, is provided with flanges 2 by which the coupler head can be connected to a drawbar, not shown, by means of a flange coupling commonly occurring in this context. In the front end of the coupler head, a front plate 3 is supported from which a guide cone 4 projects in a conventional way. The front plate 3 is supported by a coupler house 5 that protects components included in a mechanical coupling, such as a coupling link 6 and a central plate 7, which are rotatably arranged on a vertically oriented main shaft 8. Outside the coupler house, locking and unlocking members 9 and 10, respectively, are arranged, by which the central plate can be manoeuvred into its locked and unlocked positions. Further, on the coupler head 1, members 11 are arranged for the connection and supply of occurring hydraulic, pneumatic and electric functions as well as for the communication between coupled rail vehicles. These members 9-11 are incidental to the invention and may be of a conventional kind known per se and do not need to be treated in more detail in this description of the invention.

The coupler head 1 consists of four main components: a beam 12 that runs centrally in the coupler head and to which, in opposite sides, a respective house part 13 and 14 forming a coupler house should be joined, as well as said front plate 3 that should be connected to the parts 13 and 14 of the coupler house. The parts 13, 14 of the coupler house are each other's mirror images and may be symmetrically uniform and interchangeable with each other. The parts 13, 14 of the coupler house are made of sheet metal and have, according to the embodiment example, by longitudinal bendings 15, been bent integrally into the shape of a truncated pyramid that in an obliquely cut and open long side is welded to the beam 12 (see FIG. 6). Accordingly, the welding seams 16 extend principally in the longitudinal direction of the beam, and the bendings 15 run divergingly from the beam 12 toward the front plate 3.

Figure 2:
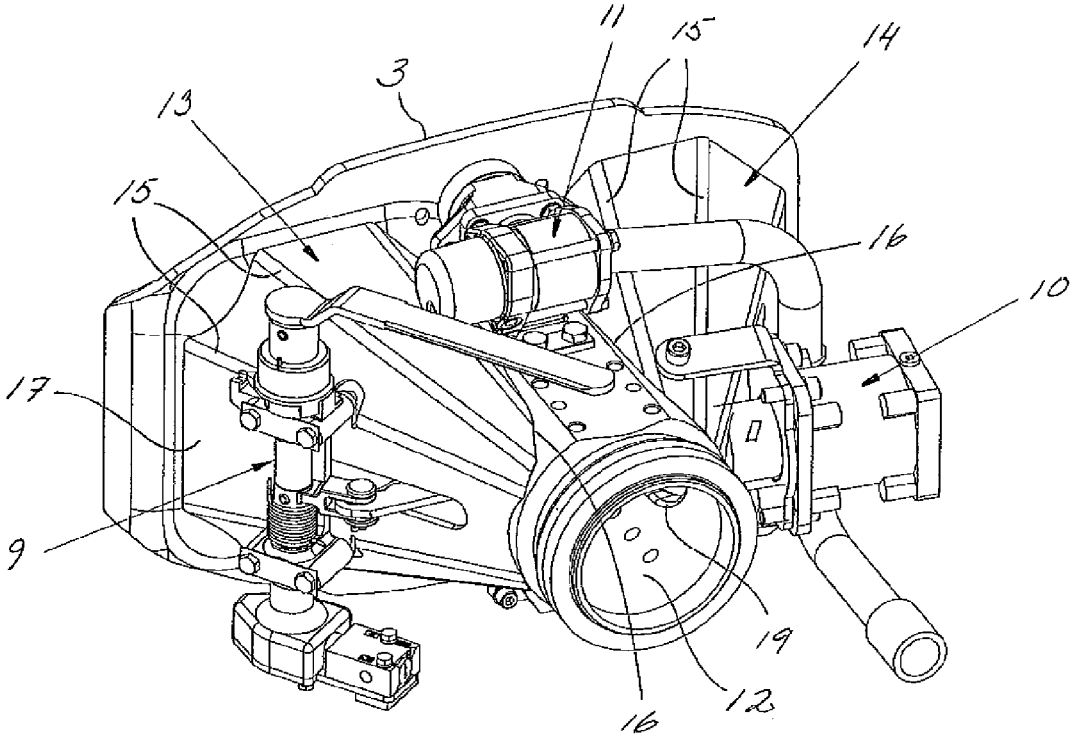
FIG. 2 shows a coupler head according to the invention in perspective from behind.
Figure 3:
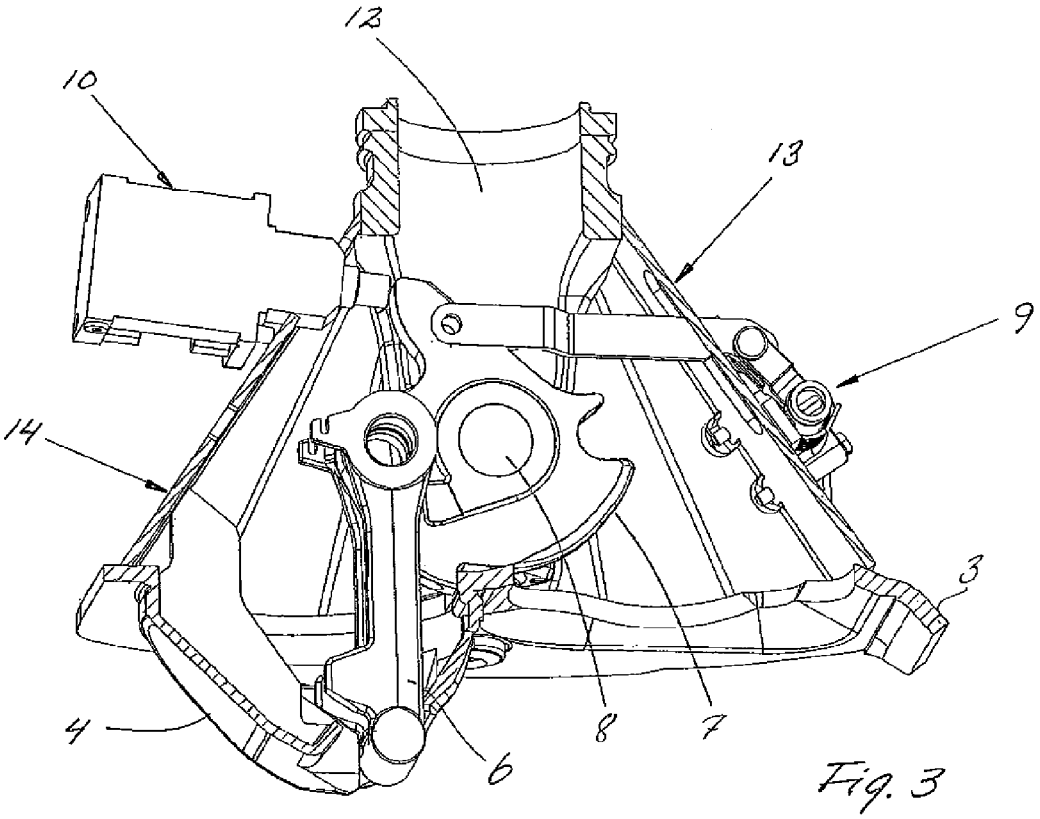
FIG. 3 shows a horizontal cross-section through the coupler head.
Figure 4:
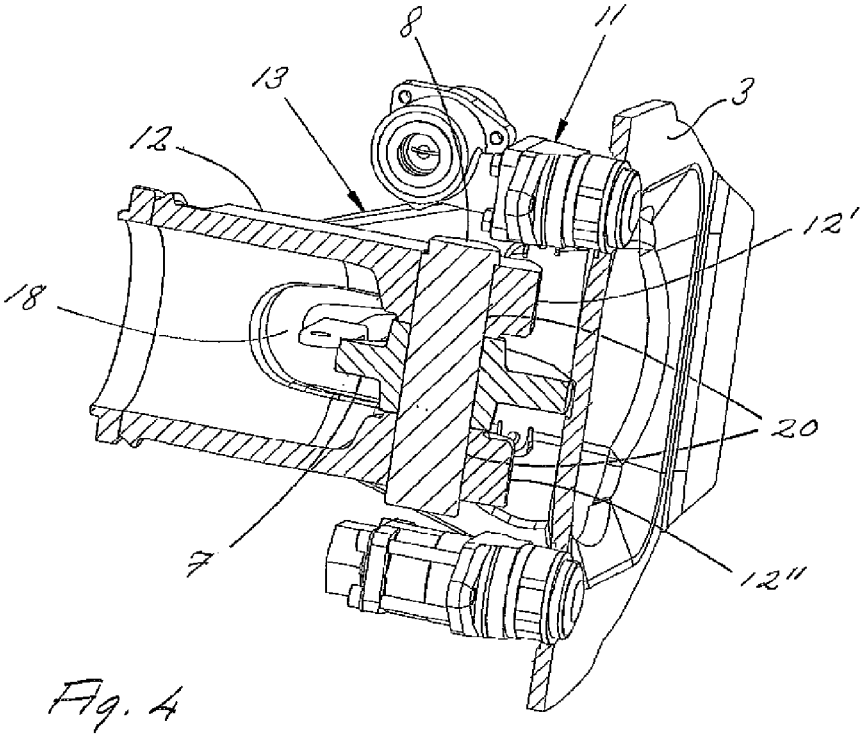
FIG. 4 shows a vertical cross-section through the coupler head.
Figure 5:
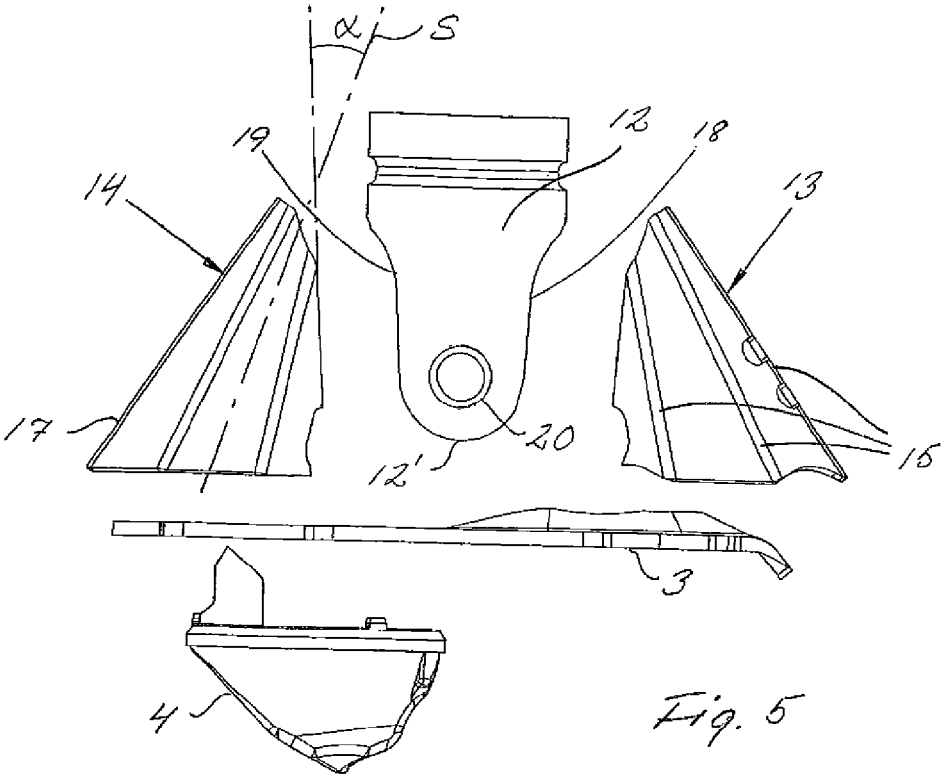
FIG. 5 shows the parts of the coupler house in the unmounted state.

The house part 13, 14 of the embodiment example has a vertically standing outside 17, which in its upper edge transforms into an upper side (visible in FIG. 2) angled in three different planes and transforms in its lower edge into an under side (visible in FIG. 3) angled in three different planes. Accordingly, each house part 13 or 14 has six rectilinear bendings (and seven essentially plane sides) by which thrust forces are transferred at an acute angle from the front plate 3 to the beam 12. In their front ends, the parts 13, 14 of the coupler house are welded to the front plate 3. Thereby, the front plate 3 serves the purpose of interconnecting the house parts and contributes to impart the coupler house increased strength to resist lateral loads in order to, in this way, further counteract fatigue and prevent separation in the welding seams 16, caused by, for instance, a flow of thrust forces from the front plate 3 to the beam 12 and the drawbar via the house parts 13 and 14.

According to the invention, the main shaft 8 of the mechanical coupling is journalled in the centrally running beam 12. For this purpose, two laterally positioned recesses 18, 19 opposite each other are formed in the wall of the beam so as to allow accommodation of the central plate, the coupling link and other appurtenant members that are necessary for the manoeuvring of the mechanical coupling. By these recesses 18, 19, which connect the spaces in the two laterally positioned coupler house parts, the front end of the beam obtains the shape of a fork with an upper branch 12' and a lower branch 12". In the branches 12' and 12", seats 20 are arranged for bearing the main shaft 8, and for the purpose, the branches may be reinforced and have increased material thickness in the area in which the bearing of the main shaft is arranged.

Figure 6:
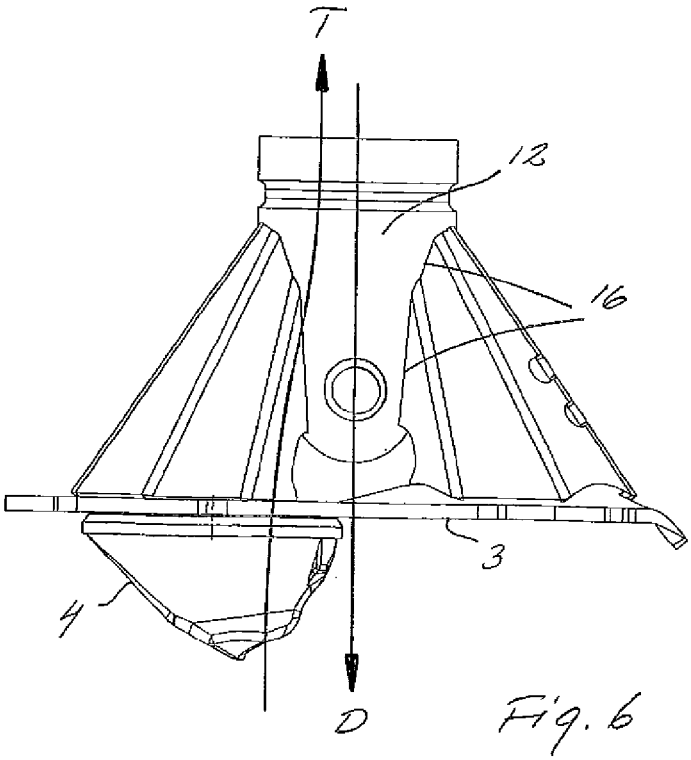
FIG. 6 shows the parts of the coupler house in the mounted state.

In other words, in a coupler head according to the invention, tractive forces and thrust forces are propagated in different paths through the coupler head, such as illustrated in FIG. 6, wherein arrow D indicates flow of force in the traction direction while arrow T indicates flow of force in the thrust direction. In this way, on one hand the welding seams and the coupler house are spared from tractive forces, while the coupling, the main shaft and the bearing thereof in the centrally running beam are spared from thrust forces.

As mentioned above under Summary of the Invention, the parts 13, 14 of the coupler house may have another design than the polygonal embodiment shown in the drawings. In order to comply with the object of the invention, the parts of the coupler house are formed of sheet metal, preferably sheet steel, which by bending and/or compression-moulding is imparted a self-supporting elongate shape, preferably an obliquely truncated conical or pyramidal shape, and which, at an open side of the house part, is joined to the centrally running beam by means of a welding seam running principally in the longitudinal direction of the beam.

Here, it should be mentioned that in alternatives to bending/compression-moulding, the parts of the coupler house may be produced by the joining of individual side elements, wherein the diverging bendings 15 instead will consist of diverging welding seams. Even if this alternative embodiment may be less meritorious from the point of view of manufacturing and strength, it could be a feasible alternative to the integrally formed coupler house part 13 or 14 included in the embodiment example.

It will be further appreciated that the centrally running beam 12, which in the embodiment example is formed of a cylindrical pipe having a circular cross-section, alternatively may have another cross-sectional shape, such as a four-sided cross-section.

Based on the above description of the solution, it is within the reach of the person skilled in the art to modify the embodiment example while retaining the technical effect of the invention and without deviating from the general idea of the invention, and therefore the invention is not limited to the described detailed embodiment but should be considered to embrace all such modifications thereof that are comprised in the attached claims.

The invention claimed is:

1. A coupler head (1) in automatic couplers for rail vehicles, comprising:

a coupler house (13, 14) formed to contain components (6, 7, 8) included in a mechanical coupling and, in a front end, to support a front plate (3), wherein the coupler house consists of two separate elongate shell-shaped house parts (13, 14), which in mutually opposite and open long sides are individually joined to an outside of a beam (12) that runs centrally in the coupler head and in a rear end is adapted to be coupled to a drawbar and in a front end adapted for bearing a main shaft (8) included in the mechanical coupling, the front end of the beam being located at a distance away from the front plate, and the shell-shaped house parts of the coupler house being joined to the outside of the beam by welding seams (16) that run in a longitudinal direction of the beam, whereby tractive forces (D) are transferred from the mechanical coupling to the drawbar via the centrally running beam without loading said shell-shaped house parts and welding seams, while thrust forces (T) are transferred from the front plate indirectly to the beam and the drawbar via said shell-shaped house parts and welding seams without loading the mechanical coupling, the main shaft of the mechanical coupling, and a bearing of the main shaft in the beam.

2. The coupler head according to claim 1, wherein each of the shell-shaped house parts (13, 14), by a plurality of longitudinally running bendings (15), forms a polygonal shell, the longitudinally running bendings for each shell-shaped house part extending divergingly from the beam (12), whereby thrust forces are propagated at an acute angle inward toward the beam.

3. The coupler head according to claim 2, wherein each of the shell-shaped house parts (13, 14) embrace a vertically standing side (17) formed between an upper side angled in two or more different planes and an under side angled in two or more different planes.

4. The coupler head according to claim 1, wherein vertical sides (17) of the coupler house are adapted for a mounting of control members (9, 10) for the mechanical coupling, and wherein the beam, on any of an upper and/or under side, is adapted for mounting connection members (11) for supplying the rail vehicle.

5. The coupler head according to claim 1, wherein the shell-shaped house parts of the coupler house are compression-moulded.

6. The coupler head according to claim 1, wherein the beam (12) is formed of a pipe, a wall of said pipe having through recesses (18, 19) that connect spaces in the shell-shaped house parts (13, 14), and wherein a front end of the beam by the recesses is fork-shaped and adapted for bearing the main shaft (8) of the coupling.

7. The coupler head according to claim 2, wherein vertical sides (17) of the coupler house are adapted for a mounting of control members (9, 10) for the mechanical coupling, and wherein the beam, on any of an upper and/or under side, is adapted for mounting connection members (11) for supplying the rail vehicle.

8. The coupler head according to claim 3, wherein the vertical sides (17) are adapted for a mounting of control members (9, 10) for the mechanical coupling, and wherein the beam, on any of an upper and/or under side, is adapted for mounting connection members (11) for supplying the rail vehicle.

9. The coupler head according to claim 2, wherein the shell-shaped house parts of the coupler house are compression-moulded.

10. The coupler head according to claim 2, wherein the beam (12) is formed of a pipe, a wall of said pipe having through recesses (18, 19) that connect spaces in the shell-shaped house parts (13, 14), and wherein a front end of the beam by the recesses is fork-shaped and adapted for bearing the main shaft (8) of the coupling.

11. The coupler head according to claim 4, wherein the connection members (11) are configured for supplying the rail vehicle with any of the group consisting of: air, oil, and electricity.

12. The coupler head according to claim 7, wherein the connection members (11) are configured for supplying the rail vehicle with any of the group consisting of: air, oil, and electricity.

13. The coupler head according to claim 8, wherein the connection members (11) are configured for supplying the rail vehicle with any of the group consisting of: air, oil, and electricity.

* * * * *